US008391744B2

(12) United States Patent
Tanaka et al.

(10) Patent No.: US 8,391,744 B2
(45) Date of Patent: Mar. 5, 2013

(54) CHARGER, IMAGE FORMING UNIT AND IMAGE FORMING APPARATUS HAVING A REGULAR REPEATING MESH PATTERN THAT IS CHANGED IN A PERIPHERAL REGION

(75) Inventors: Arichika Tanaka, Ebina (JP); Satoshi Shigezaki, Ebina (JP); Kuniaki Tanaka, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 354 days.

(21) Appl. No.: 12/728,329

(22) Filed: Mar. 22, 2010

(65) Prior Publication Data

US 2011/0058844 A1 Mar. 10, 2011

(30) Foreign Application Priority Data

Sep. 8, 2009 (JP) ..... 2009-206816

(51) Int. Cl.
*G03G 15/02* (2006.01)

(52) U.S. Cl. ..... 399/100; 399/171

(58) Field of Classification Search ..... 399/100, 399/171; 250/324–326
See application file for complete search history.

(56) References Cited

U.S. PATENT DOCUMENTS

| | | | | |
|---|---|---|---|---|
| 6,246,852 | B1 * | 6/2001 | Branch et al. | 399/171 |
| 7,212,771 | B2 * | 5/2007 | Tanaka et | 399/171 |
| 7,272,337 | B2 * | 9/2007 | Owens | 399/100 |
| 7,835,667 | B2 * | 11/2010 | Ohno et al. | 399/171 |
| 2008/0069586 | A1 * | 3/2008 | Dangelmaier et al. | 399/100 |
| 2010/0054793 | A1 * | 3/2010 | Parks | 399/100 |

FOREIGN PATENT DOCUMENTS

JP 2005-338797 A 12/2005

* cited by examiner

*Primary Examiner* — Susan Lee
(74) *Attorney, Agent, or Firm* — Sughrue Mion, PLLC

(57) ABSTRACT

A charger includes: a first electrode; a second electrode that has a mesh pattern and is arranged on a side closer to a photoconductor than the first electrode; a cleaner that moves along the second electrode to clean the second electrode by a brush thereof. The second electrode has the mesh pattern successively arranged in a certain direction, and a peripheral region of the mesh pattern of the second electrode has been changed to prevent catching of the brush of the cleaner.

15 Claims, 5 Drawing Sheets

CHARGER, IMAGE FORMING UNIT AND IMAGE FORMING APPARATUS HAVING A REGULAR REPEATING MESH PATTERN THAT IS CHANGED IN A PERIPHERAL REGION

CROSS-REFERENCE TO RELATED APPLICATION

This application is based on and claims priority under 35 USC 119 from Japanese Patent Application No. 2009-206816 filed on Sep. 8, 2009.

BACKGROUND

Technical Field

This invention relates to a charger, an image forming unit and an image forming apparatus.

SUMMARY

According to an aspect of the invention, a charger includes: a first electrode; a second electrode that has a mesh pattern and is arranged on a side closer to a photoconductor than the first electrode; a cleaner that moves along the second electrode to clean the second electrode by a brush thereof, wherein the second electrode has the mesh pattern successively arranged in a certain direction, and a peripheral region of the mesh pattern of the second electrode has been changed to prevent catching of the brush of the cleaner.

BRIEF DESCRIPTION OF THE DRAWINGS

Embodiments of the invention will be described in detail based on the following figures, wherein.

DETAILED DESCRIPTION

Figure 1:
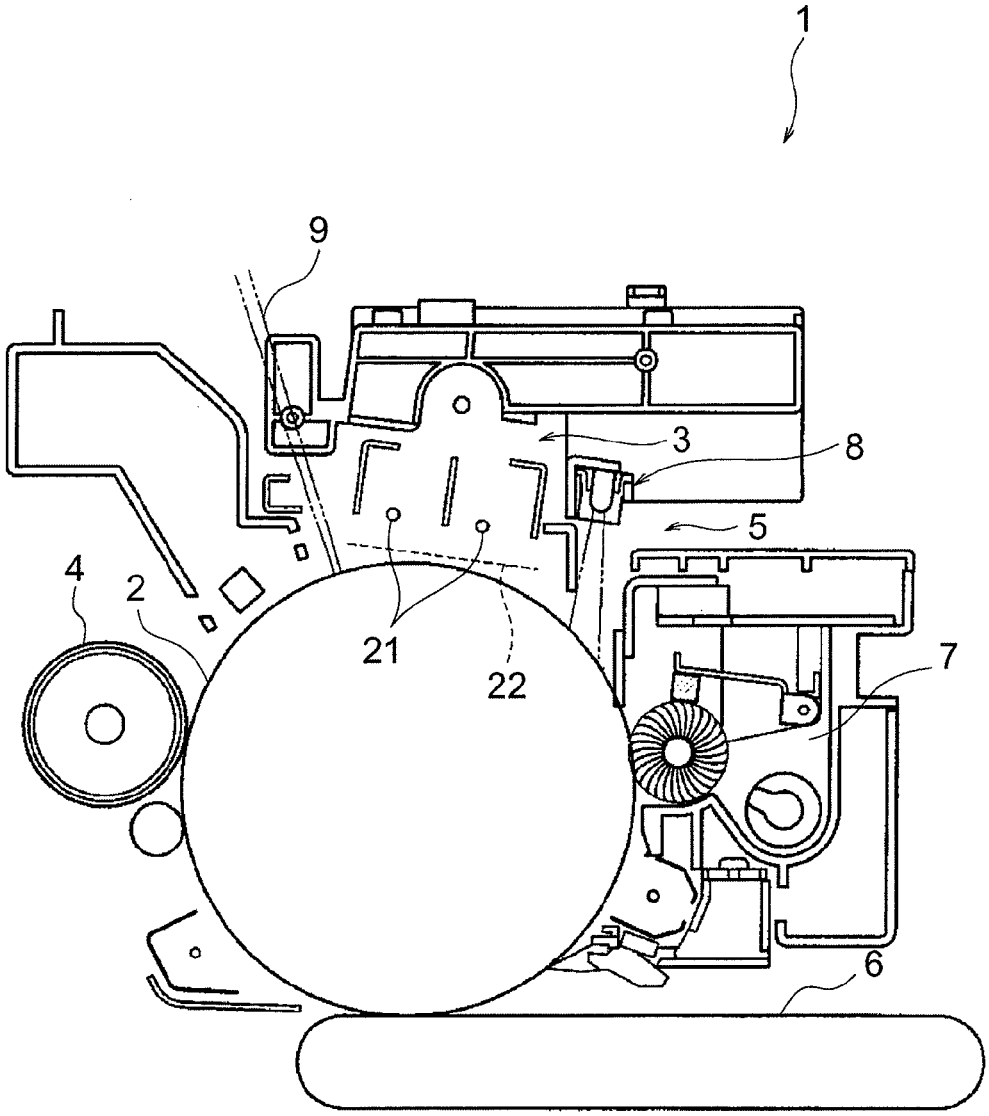
FIG. 1 is a view for explaining the entire arrangement of an image forming apparatus according to an embodiment of this invention.

Hereinbelow, referring to the drawings, an explanation will be given of an embodiment of this invention.

FIG. 1 is a view for explaining the entire arrangement of an image forming apparatus according to an embodiment of this invention.

The image forming apparatus 1 is an apparatus which forms an image on a printing medium such as a sheet of paper in an electrophotographic system. The image forming apparatus 1 is provided with a photoconductor drum 2. Arranged around the photoconductor drum 2 are a charger 3, a developer 4, a transfer belt 6, a cleaner 7 and discharger 8 which are various devices for forming an image through an electrophotographic process (their detailed explanation will not be given). A reference symbol 9 denotes exposure light employed to expose the photoconductor drum 2 by means of an exposure device not shown. Further, the charger 3 and photoconductor drum 2 are united to constitute an image forming unit 5 in which the charger 3 and the photoconductor drum 2 are unitedly detachable from the image forming apparatus 1.

Figure 2:
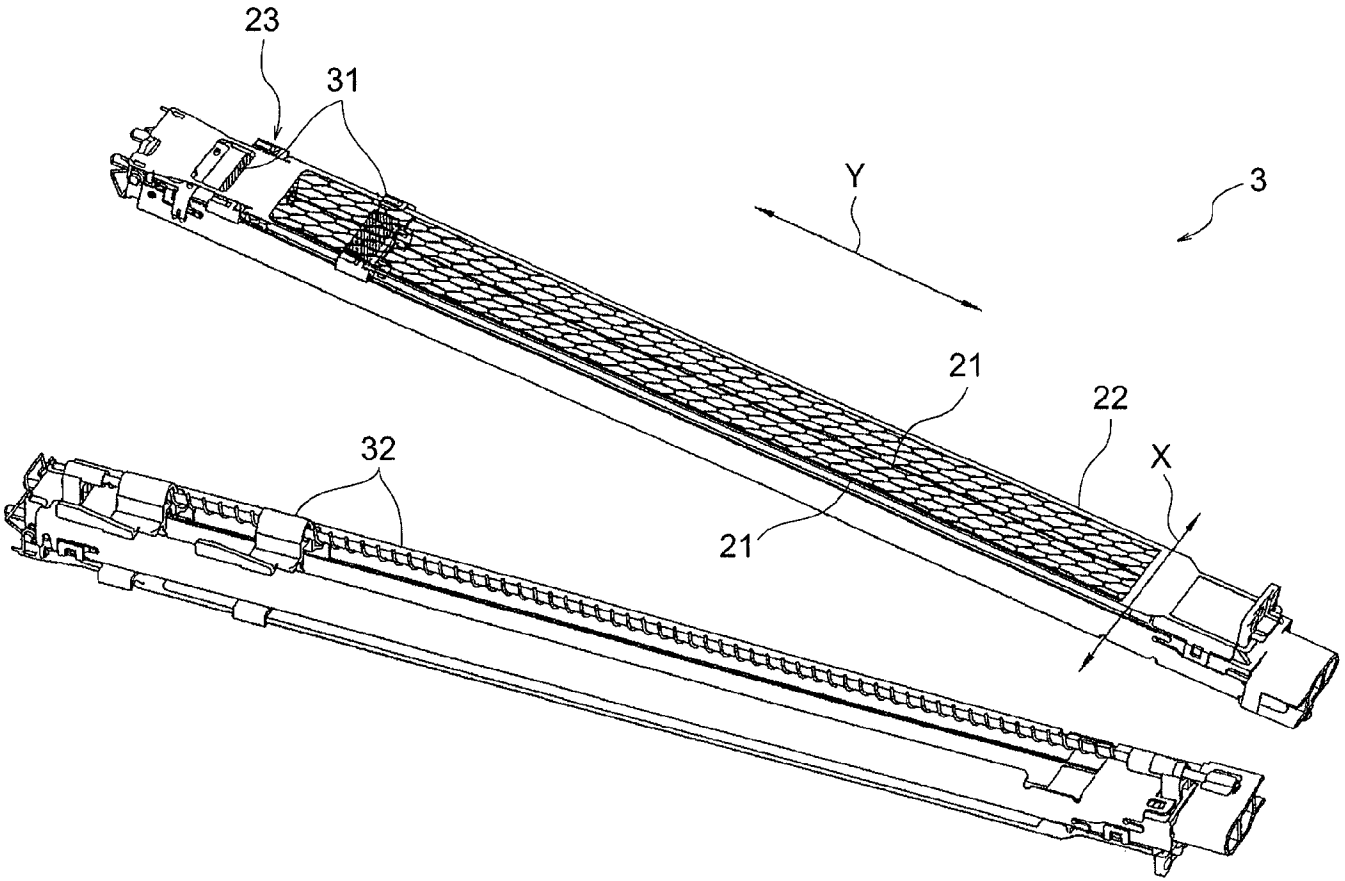
FIG. 2 is an exploded perspective view of a charger in the image forming apparatus according to an embodiment of this invention.
Figure 3:
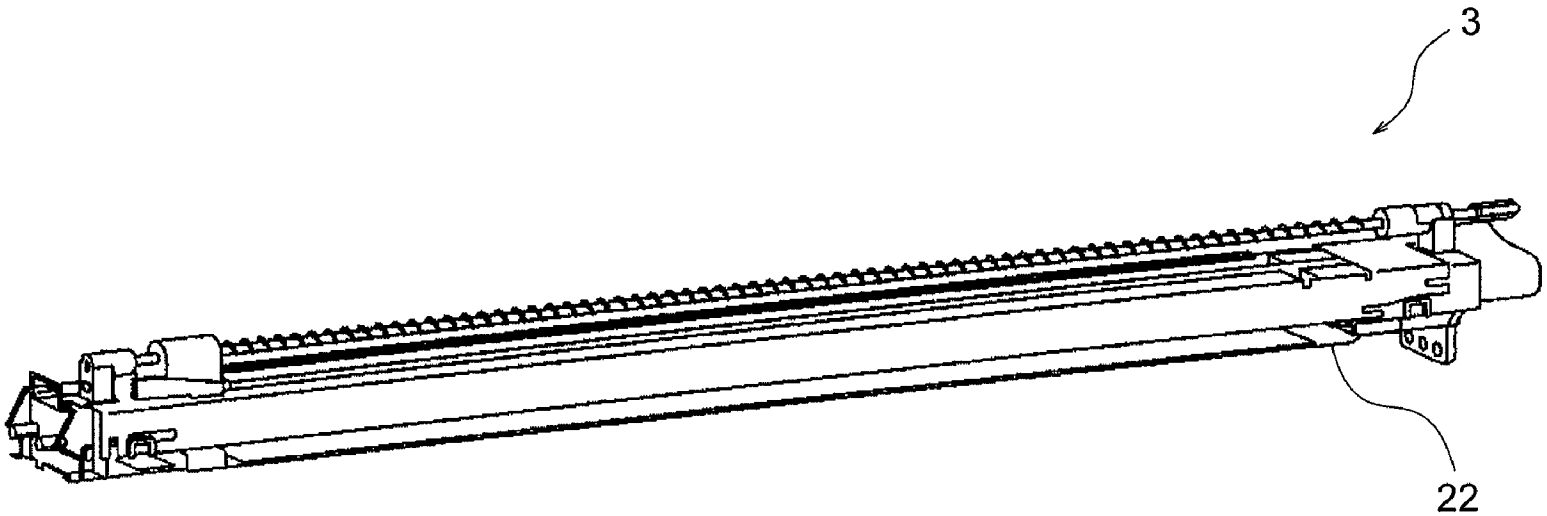
FIG. 3 is a perspective view of a part of a charger in the image forming apparatus according to an embodiment of this invention.

FIG. 2 is an exploded perspective view of the charger 3. FIG. 3 is a perspective view of a part of the charger 3.

The charger 3 is a long, narrow device arranged along the direction of a rotary axis of the photoconductor drum 2. The charger 3 includes two wire electrodes 21, a grid electrode 22 located between the wire electrodes 21 and the photoconductor drum 2 and a cleaner 23 which moves in a direction orthogonal to the moving direction of the photoconductor drum 2 to clean the grid electrode 22. An electrode lateral direction X of the charger 3 is a direction orthogonal to the wire electrodes 21, which is the same direction of the moving direction (rotating direction) of the photoconductive drum 2.

The cleaner 23 includes a brush 31 in pressure-contact with the grid electrode 22 from a side where the wire electrodes 21 are arranged and a moving mechanism 32 which slidably moves the brush 31 under a pressure-contact along the rotating direction of the photoconductor drum 2 (i.e. along the electrode lateral direction X of the grid electrode 22). In this cleaner 23, the brush 31 slides on the grid electrode 22 along an electrode longitudinal direction Y (direction of the rotating axis of the photoconductor drum 2) thereby to clean the grid electrode 22.

A higher voltage is applied to the wire electrodes 21 than to the grid electrode 22 and discharged to the photoconductor drum 2 to charge its surface. The grid electrode 22 has a function of wholly unifying the charging of the surface of the photoconductor drum 2. On the surface of the grid electrode 22, owing to discharging, a discharging product (nitrogen oxide) will be deposited. This discharging product, which is an insulator, impairs the electrode performance so that it will be cleaned by the cleaner 23. This cleaning operation is performed whenever a thousand to several thousands of sheets of images are formed.

Figure 4:
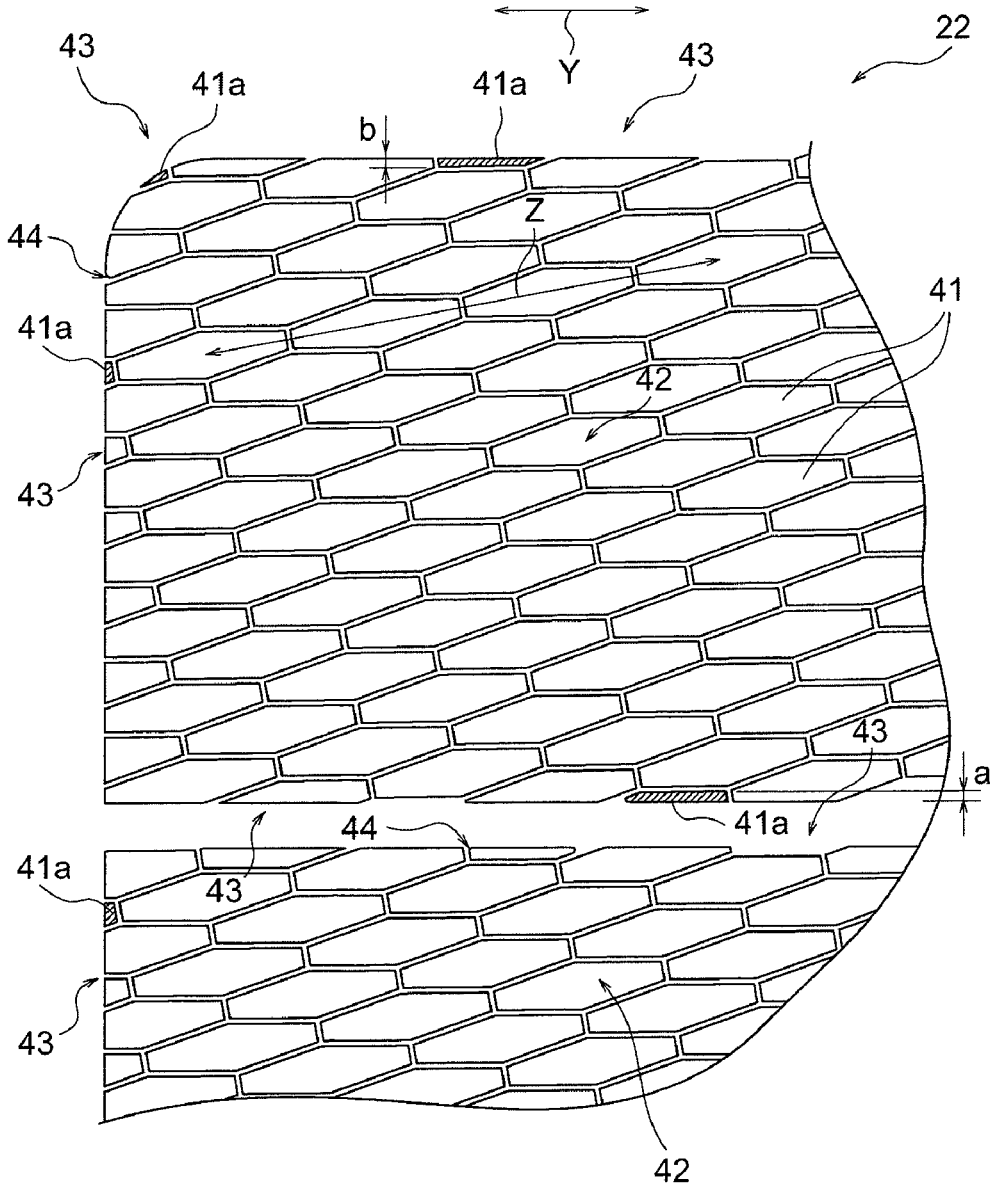
FIG. 4 is a partial enlarged plan view of a grid electrode in the image forming apparatus according to an embodiment of this invention.
Figure 5:
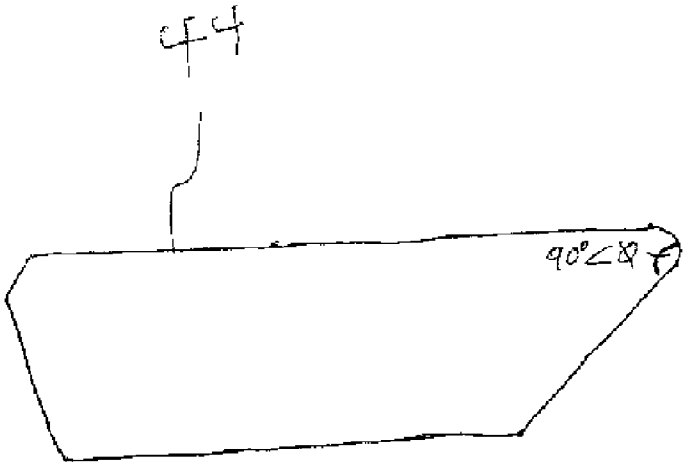
FIG. 5 is an enlarged view of a grid electrode in the image forming apparatus according to an embodiment of this invention.

FIG. 4 is a partial enlarged plan view of the grid electrode 22.

The grid electrode 22 is formed in a shape longer in the longitudinal direction of the charger 3, in which a large number of the same mesh-patterns are successively arranged in a certain direction (Z direction). For example, the line width of the mesh-pattern is 0.1 mm or so. The interior of the mesh-pattern constitutes an opening 41. The Z direction forms an acute angle with the Y direction. This intends to relieve the hitting of the brush 31 against the mesh pattern of the grid electrode 22.

While the cleaner 23 cleans the grid electrode 22, pile of the brush 31 may be caught in the opening 41 so that a white line is generated on the image formed on the printing medium. So, the grid electrode 22 adopts a means for preventing the pile of the brush 31 from being caught in the opening 41 as described below.

As already described, the grid electrode 22 has a large number of the same mesh-patterns successively arranged in a certain direction (Z direction). If the same patterns are formed like this, in a region 42 closer to the center of the grid electrode 22, the same mesh-patterns will be formed correctly. However, because the vertical/horizontal size of the grid electrode 22 is fixedly determined, in a peripheral region of the grid electrode 22, one mesh will not be formed in its complete pattern but will be chipped.

Usually, as shown in FIG. 4, plural of mesh patterns partially chipped appear in the peripheral region 43; in this case, in at least one of them, the mesh pattern is changed. Namely, the shape of the opening 41, which will be uniquely determined if the same mesh patterns are caused to successively appear in the Z direction, is changed. This intends to prevent the pile of the brush 31 from being caught in the opening 41.

Concretely, if the width of the shape of the opening 41 is smaller than a predetermined size regarding the mesh pattern partially chipped in the peripheral region 43, the mesh pattern is not formed, or its shape is changed to enlarge the width (exemplified as widths "a" and "b" in FIG. 4, now these widths include vertical and horizontal widths). The width of the shape of the opening 41 will be uniquely determined if the same mesh patterns are caused to successively appear in the Z direction. A shaded region 41*a* in FIG. 4 represents such a case. In this region, although the opening 41 is to be formed if the same mesh patterns are caused to successively appear in the Z direction, the mesh pattern is changed so as not to form the opening 41 (the opening 41 is not formed but filled with an electrode material). Specifically, the width of the opening 41 on the mesh pattern may be formed in the proportion of more than 0.15 mm of the opening 40 to 0.1 mm of the brush 31.

The concrete size of the width which is a standard for determining whether or not the opening 41 should be formed will be determined according to various conditions such as the thickness of the pile of the brush 31 and the etching performance in the step of forming the opening 41 (according to the etching performance, if the opening 41 difficult to work is formed, burrs are likely occur on the edge of the opening 41 and the pile of the brush 31 is likely to be caught by the burrs).

Further, even if the pertinent width in the peripheral region 43 is relatively large so that the opening 41 is formed, where a region making an angle smaller than a predetermined angle appears in the edge shape of the opening 41 if the same mesh patterns are caused to successively appear in the Z direction, in this region, a curve will be formed. Otherwise, the angle of the side continuous to the edge is changed so that the edge shape of the opening 41 forms an angle larger than the predetermined angle (region indicated by reference symbol 44 in FIG. 4). Thus, no acute angle is formed in the edge of the opening 41. Specifically, the angle of the opening 41 on the mesh pattern may be formed in more than 90 degrees regarding 0.1 mm of the brush 31, or the angle of the opening 41 may be formed in curved shape.

The predetermined angle is also determined according to the thickness of the pile of the brush 31 and other various conditions.

The example of the invention is described below. In a case that the line thickness of the brush is 0.1 mm, by removing that the width of the opening on the mesh pattern is 0.15 mm less or equal and forming larger opening on the mesh pattern, the catch of the brush has not been caused. By changing a part of the mesh pattern of which the angle is less than 90 degrees to curved shape, the catch of the brush has not been caused. By changing the angle on a part of the mesh pattern from less than 90 degrees to 90 degrees more or equal, the catch of the brush has not been caused.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A grid electrode comprising:

an electrode that has a mesh pattern formed with a plurality of openings formed in a regular, repeating arrangement, and the electrode is configured to be arranged on a side closer to a photoconductor than another electrode;

wherein the electrode has the mesh pattern successively arranged in a certain direction, and a peripheral region of the mesh pattern of the electrode is formed such that the regular, repeating arrangement is disrupted to prevent catching of a brush of a cleaner.

2. An image forming unit comprising:

a photoconductor; and a grid electrode according to claim 1 that charges a surface of the photoconductor.

3. An image forming apparatus comprising:

a photoconductor;

a grid electrode according to claim 1 that charges a surface of the photoconductor; and a developer that develop an electrostatic latent image on the photoconductor by toners.

4. The grid electrode according to claim 1, wherein a part of the peripheral region of the mesh pattern of the electrode is formed discontinuously.

5. The grid electrode according to claim 1, wherein a part of the peripheral region of the mesh pattern of the electrode a portion of an opening that is filled in with electrode material.

6. A grid electrode comprising:

an electrode that has a mesh pattern and is configured to be arranged on a side closer to a photoconductor than another electrode;

wherein the electrode has the mesh pattern successively arranged in a certain direction, and a peripheral region of the mesh pattern of the electrode has been changed to prevent catching of a brush of a cleaner, wherein a part of the peripheral region of the mesh pattern of the electrode is formed discontinuously.

7. A grid electrode comprising:

an electrode that has a mesh pattern formed with a plurality of openings formed in a regular, repeating arrangement, and the electrode is configured to be arranged on a side closer to a photoconductor than another electrode;

wherein the electrode has the mesh pattern successively arranged in a certain direction, and an opening of a peripheral region of the mesh pattern of the electrode is formed such that the regular, repeating arrangement is disrupted by having a width larger than a predetermined width.

8. The grid electrode according to claim 7, wherein the width of the opening is 0.15 mm less or equal.

9. An image forming unit comprising:

a photoconductor; and a grid electrode according to claim 7 that charges a surface of the photoconductor.

10. An image forming apparatus comprising:

a photoconductor;

a grid electrode according to claim 7 that charges a surface of the photoconductor; and a developer that develop an electrostatic latent image on the photoconductor by toners.

11. A grid electrode comprising:

an electrode that has a mesh pattern formed with a plurality of openings formed in a regular, repeating arrangement, and the electrode is configured to be arranged on a side closer to a photoconductor than another electrode;

wherein the electrode has the mesh pattern successively arranged in a certain direction and an opening of a peripheral region of the mesh pattern of the electrode is formed such that the regular, repeating arrangement is disrupted by having an edge shape making an angle larger than a predetermined angle.

12. The grid electrode according to claim 11, wherein the angle of the opening is more than 90 degrees.

13. The grid electrode according to claim 11, wherein the angle of the opening is formed in curved shape.

14. An image forming unit comprising:

a photoconductor; and a grid electrode according to claim 11 that charges a surface of the photoconductor.

15. An image forming apparatus comprising:

a photoconductor;

a grid electrode according to claim 11 that charges a surface of the photoconductor; and a developer that develop an electrostatic latent image on the photoconductor by toners.

* * * * *